United States Patent [19]

Yeardley

[11] Patent Number: 4,593,599

[45] Date of Patent: Jun. 10, 1986

[54] ROPE ASSEMBLIES

[75] Inventor: John K. Yeardley, London, England

[73] Assignee: Bridon Plc, Yorkshire, England

[21] Appl. No.: 637,720

[22] Filed: Aug. 6, 1984

[30] Foreign Application Priority Data

Aug. 12, 1983 [GB] United Kingdom ..... 8321773

[51] Int. Cl.[4] ..... D07B 1/18; D07B 1/20; D04C 1/12; B66C 1/12

[52] U.S. Cl. ..... 87/6; 87/1; 87/8; 294/74

[58] Field of Search ..... 87/1, 6, 7, 8, 5, 29, 87/30; 294/74

[56] References Cited

U.S. PATENT DOCUMENTS

| | | | |
|---|---|---|---|
| 2,082,828 | 6/1937 | Garris | 87/8 |
| 2,413,642 | 12/1946 | Mitchell | 87/8 |
| 2,435,088 | 1/1948 | Mazzella | 87/8 |
| 2,448,463 | 8/1948 | Robbins | 87/8 |
| 2,979,982 | 4/1961 | Weitzel | 87/6 |
| 3,129,631 | 4/1964 | Hill et al. | 87/6 |
| 3,155,768 | 11/1964 | Garshick | 87/6 X |
| 3,578,763 | 5/1971 | Platou | 87/6 |
| 3,849,929 | 11/1974 | Martuch | 87/1 X |
| 4,258,608 | 3/1981 | Brown | 87/6 |

FOREIGN PATENT DOCUMENTS

| | | |
|---|---|---|
| 1186968 | 4/1970 | United Kingdom . |
| 1275608 | 5/1972 | United Kingdom . |
| 1278938 | 6/1972 | United Kingdom . |

*Primary Examiner*—John Petrakes

*Attorney, Agent, or Firm*—Murray and Whisenhunt

[57] ABSTRACT

A rope assembly which floats on water comprises a load-bearing rope (e.g. of polyamide or polyester fibres or filaments), a layer of buoyant, substantially non-absorbent, flexible material (e.g. closed-cell plastics foam) arranged around the rope, and a flexible jacket (e.g. of polyamide, polyester or polypropylene fibres or filaments) outside the buoyant layer holding it in place, the buoyant material being present in such quantity that the rope assembly will float on water.

8 Claims, 3 Drawing Figures

ROPE ASSEMBLIES

DESCRIPTION

This invention is concerned with rope assemblies.

Ropes attached to buoyant mooring terminals have been fitted with collars of buoyant material to prevent them from sinking below the water surface between mooring operations. The collars have been of tubular design or of a type suitable for lacing on to the ropes.

It is an object of the present invention to provide a rope assembly which will float without the fitting of such collars.

According to the invention, a rope assembly comprises a load-bearing rope made at least predominantly of non-metallic material, a layer of buoyant, substantially non-absorbent, flexible material arranged around the rope, and a flexible jacket made at least predominantly of non-metallic material outside the layer of buoyant material holding it in place, the buoyant material being present in such quantity that the rope assembly will float on water.

The layer of buoyant material is desirably of substantially uniform thickness over its whole area (e.g. it may be in the form of sheet wound round the rope). Preferably, the buoyant material and jacket extend over substantially the whole length of the rope. The layer of buoyant material may extend over the whole length of the rope except end portions thereof (e.g. eyes), while the flexible jacket extends over the whole length of the rope including said end portions. Thus, the rope assembly may have substantially constant cross-sectional dimensions along substantially its whole length.

The jacket is preferably of braided construction. It may be secured to the rope by splicing. The jacket may comprise two end portions disposed round eyes at the ends of the rope and a main portion extending between the end portions, the jacket portions being separately formed. The rope or an external sheath forming part of the rope is preferably of braided construction.

The invention enables a floating rope assembly to be provided while using rope materials with specific gravities greater than that of sea water. Preferably, the rope is made of polyamide or polyester fibres or filaments. The buoyant material is preferably a closed-cell foam material of plastics, e.g. polyethylene. Preferably, the jacket is made of a material which provides abrasion protection for the buoyant material and rope. The jacket may suitably be made of polyamide, polyester or polypropylene, preferably in the form of fibres or filaments.

The rope may be spliced. It may be made up as either a single leg or an endless grommet, with or without thimbles at each extremity.

Figure 1:
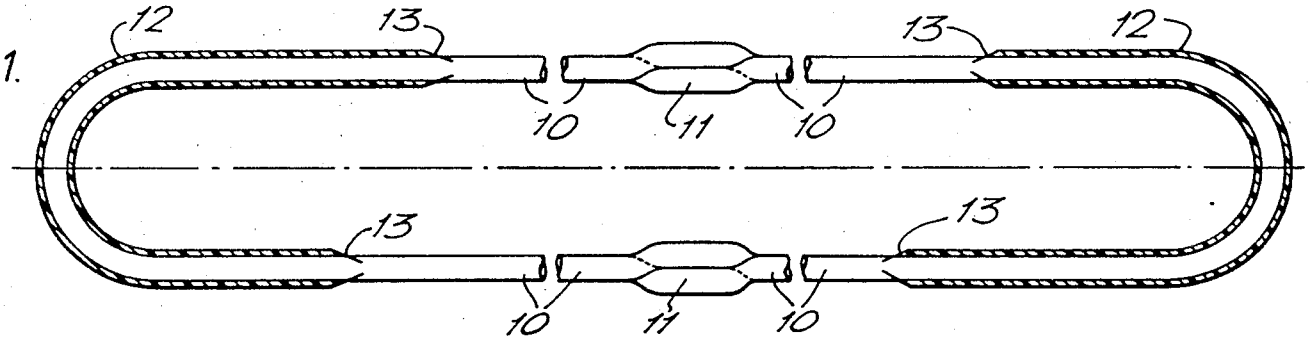
Figure 2:
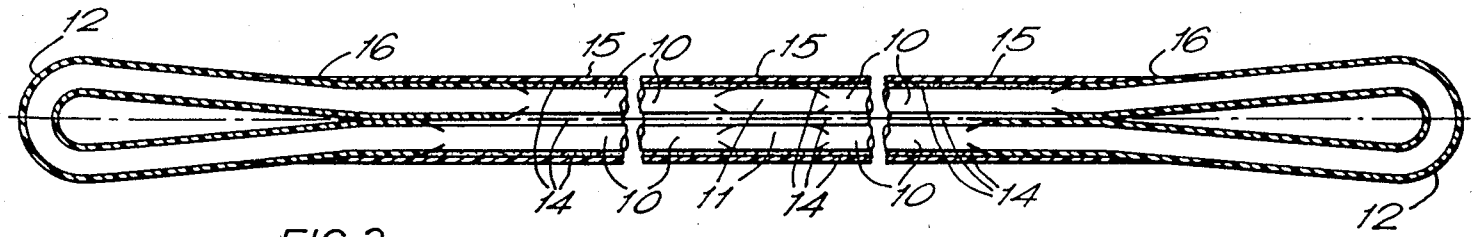
Figure 3:
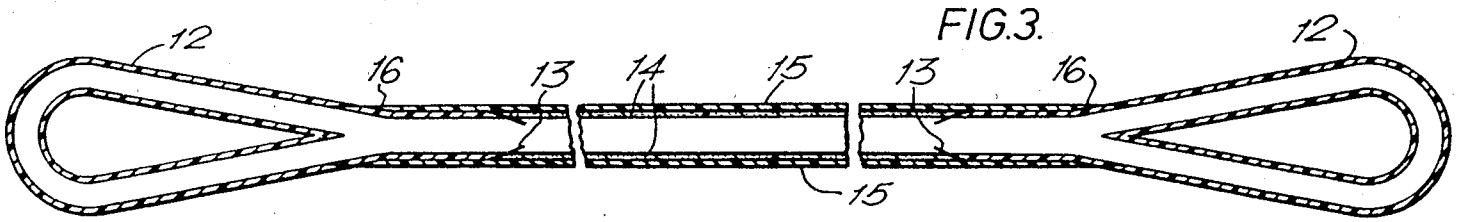

The following is a description, by way of example, of two embodiments of rope assembly in accordance with the invention, reference being made to the accompanying drawings, in which:

FIG. 1 shows in longitudinal section the first stage of assembly of a first embodiment, FIG. 2 shows in longitudinal section the second and final stage of assembly of the first embodiment, and FIG. 3 shows in longitudinal section the final stage of assembly of a second embodiment.

As shown in FIG. 1, a grommet is formed by joining two lengths of nylon rope 10 having a braided sheath by end to end splices 11 in each leg of the grommet. A braided nylon cover 12 of tubular form is provided over each eye of the grommet and is spliced at its ends at 13 into the sheath of rope 10. As shown in FIG. 2, a layer 14 of buoyant or flotation material is provided extending round the outside of, and continuously for the full length of, the grommet legs. A braided nylon cover 15 of tubular form is provided outside the layer 14 and extends for the full length of the grommet legs. The ends of the cover 15 are spliced at 16 into the covers 12. Thus, the flotation material is held in place by the cover 15, and the covers 15 and 12, which together form a jacket extending continuously over the whole length of the rope, provide abrasion protection for the flotation material and the rope.

The embodiment of FIG. 3 is similar to that of FIGS. 1 and 2 and the same reference numerals indicate similar parts. However, instead of an endless loop, the embodiment of FIG. 3 employs a single rope with a soft eye at each end formed by splicing in known manner.

In making the rope assembly, the buoyant layer 14 may be applied in various ways. In one preferred method, sheets of closed-cell foam are arranged in line with the rope 10 as the rope is drawn through a braiding machine which is applying the cover 15, so that the foam sheet becomes interposed between the rope and the cover. In another preferred method, a spiral lapping of closed-cell foam sheeting is provided around the rope prior to the braiding of the cover. In each case, it is preferred that the foam application is carried out immediately prior to braiding to ensure correct positioning of the layer 14.

The jacket is not necessarily of braided form. It may for example comprise a flexible extrusion or a sprayed-on cover (e.g. of polyurethane) or another encapsulating medium.

The rope assembly may be provided with thimbles or have soft eyes.

Instead of a braided construction of rope, other constructions may be used.

In the embodiments described with reference to the drawings, the layer of buoyant material and the jacket are applied to a spliced rope, but in some cases the buoyant layer and the jacket may be applied prior to splicing.

The rope assembly is flexible, easily handled, self-buoyant and abrasion resistant. There is no risk of the loss of floats or collars which may occur with known lace-on designs. There is also no risk of abrasion damage which may occur between individual floats currently in use. In the case of a grommet, the necessity for lashings to hold together the two legs of the grommet, which may cause undesirable constriction of the load-bearing rope, can be avoided.

I claim:

1. A rope assembly comprising a load-bearing rope, having a main portion and two end portions, made at least predominantly of non-metallic material, and having a diameter appropriate to a rope;

a layer of buoyant, substantially non-absorbent, flexible material arranged around the rope, the layer being of a thickness that is substantially less than the diameter of the rope and that is substantially uniformly thick over its whole area, and being generally in the form of sheet positioned around the rope; and a flexible jacket made at least predominantly of non-metallic material outside the layer of buoyant material and holding it in place, and being of a thickness substantially less than the diameter of the rope;

and wherein the buoyant material is present in such a quantity, and the layer thereof is of such a thickness, that the rope assembly will float on water.

2. A rope assembly according to claim 1 wherein the layer of buoyant material and the jacket extend over substantially the whole length of the rope.

3. A rope assembly according to claim 2 wherein the layer of buoyant material extends over the whole length of the rope except the end portions thereof, and the flexible jacket extends over the whole length of the rope including said end portions.

4. A rope assembly according to claim 1 in which the jacket is of braided construction, and is secured to the rope by splicing.

5. A rope assembly according to claim 1 wherein each end portion is in the form of an eye, and the jacket comprises two end portions disposed around each eye and a main portion extending between the two end portions, the jacket portions being separately formed.

6. A rope assembly according to claim 1 wherein at least the outer part of the rope is of braided construction.

7. A rope assembly according to claim 1 wherein the rope is made of polyamide or polyester fibers or filaments, the buoyant material is a closed-cell foam plastics material, and the jacket is made of polyamide, polyester or polypropylene in the form of fibers or filaments.

8. A rope assembly according to claim 1 wherein the rope is made up as an endless grommet.

* * * * *